United States Patent [19]

Vexler

[11] 4,402,789

[45] Sep. 6, 1983

[54] METHOD OF COATING AN INSULATED ELECTRICAL CONDUCTOR

[75] Inventor: Gavriel L. Vexler, Montreal West, Canada

[73] Assignee: Northern Telecom Limited, Montreal, Canada

[21] Appl. No.: 303,218

[22] Filed: Sep. 18, 1981

[51] Int. Cl.[3] ..... B05D 5/12

[52] U.S. Cl. ..... 162/106; 427/118; 427/120; 264/135; 264/174; 174/121 B; 174/121 SR; 174/122 R; 174/124 R

[58] Field of Search ..... 427/117, 118, 120; 174/121 B, 121 SR, 122 R, 124 R; 162/106; 264/174, 135

[56] References Cited

U.S. PATENT DOCUMENTS 2,096,448 10/1937 Clark ..... 174/121 B
2,359,590 10/1944 Smith ..... 174/121 B
3,790,694 2/1974 Portinari ..... 174/121 SR
4,131,690 12/1978 Jukes et al. ..... 427/32

FOREIGN PATENT DOCUMENTS 448488 5/1948 Canada ..... 162/106
331376 3/1930 United Kingdom ..... 174/121 B

*Primary Examiner*—Norman Morgenstern
*Assistant Examiner*—Richard Bueker
*Attorney, Agent, or Firm*—R. J. Austin

[57] ABSTRACT

Provision of a protective cover for a fibrous layer of insulation on a conductor by forming an inner layer of the protection cover by depositing a polymeric based composition without creating a crushing effect, and then, in tandem, hardening the inner layer and applying a second coat by extrusion. The inner layer absorbs the crushing forces of extrusion to protect the fibrous layer during addition of the second layer. The inner layer is preferably formed by electrostatic deposition coating and prevents pinhole formation in the second layer.

3 Claims, 3 Drawing Figures

METHOD OF COATING AN INSULATED ELECTRICAL CONDUCTOR

Figure 1:
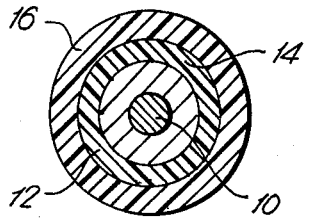

This invention relates to methods of coating insulated lectrical conductors and to electrical conductors prouced thereby.

In the manufacture of insulated electrical conductors or use in the telecommunications industry such as main rame or switchboard wires, it is normal to insulate the onductors with an insulation layer of fibrous material uch as wood pulp. An insulation layer of fibrous mateial provides excellent insulating properties while minizing the outside diameter of the insulation.

Wood pulp insulation has, however, inherent disadantages. These are that the pulp is frangible, it does not dhere well to the conductor, has extremely low abraion resistance, and is not particularly resistant to fire or lame spread. Hence, a layer of wood pulp requires urrounding protection. This is normally provided by n outer protective layer or layers which provide better lame retardancy, abrasion resistance and is not frangile. In one manner of providing such protection as lescribed in U.S. Pat. No. 4,131,690 granted Dec. 26, 978 to J. A. Jukes and P. A. McGettigan, two protecive layers are provided. This specification discusses the problems involved in attempts to extrude polymeric naterial such as nylon over the pulp, because of the lifficulty in obtaining a thin, pin-hole free and uniform coating on the polymeric material. It is considered that hese difficulties are created by the nature of the underying pulp, i.e. that it is not smooth and because it is also porous. A further difficulty which would be associated with extruding a polymeric protection over the pulp is hat the extrusion pressure would be sufficient to crush he pulp. This would cause the pulp to lose a high percentage of its air space upon which reliance is placed for he insulation properties of the pulp. Thus the pulp nsulation characteristics would be insufficient. Hence, it has been considered impractical to extrude polymeric material over pulp insulation although, by its nature, an extruded layer would have excellent elongation properties which would render it suitable for protecting broken ends of conductor when sufficient tensile load is applied to cause failure.

In order to provide polymeric protection overlying the pulp, the above U.S. Pat. No. 4,131,690 is concerned with applying the protective layers by an electrostatic coating process. In this process, after the application and drying of the pulp, the pulp coated conductor is passed over a fluidized bed and fluidized particles of a polymeric powder material for the inner protective layer are attracted to the roughened pulp surface electrostatically. The powder particles are then fused together to form the inner layer by passage through an oven of the pulp coated conductor bearing the powder. The second or outer protective layer is then applied in a similar fashion onto the inner layer. This electrostatic deposition process as described in the above U.S. patent provides the pulp with a polymeric protection which avoids the formation of the pinholes which would beset the extrusion process over pulp.

Also, as no pressure is applied to the pulp during the electrostatic deposition process, then the pulp is not crushed and the insulation characteristics of the pulp are not adversely affected. Hence, the electrostatic deposition process enables the desired insulation characteristics to be retained by the pulp thereby overcoming another disadvantage of the extrusion process.

However, the electrostatic deposition process is accompanied by other disadvantages. One of these is that it does not provide a protective layer with adequate strength in the axial direction of the conductor to guarantee that its elongation will be sufficient to cause it to extend over broken ends of a conductor and prevent a short circuit. Under the circumstances, to achieve the best possible elongation characteristics, it is imperative that additives are omitted from one of the two layers by the electrostatic deposition process. As described in U.S. Pat. No. 4,131,690, the additives, which are colouring and flame retardant materials, are omitted from the outer protective layer and are placed solely in the composition of the inner layer. Use of electrostatic powder grade polymer and the restrictions concerning the outer protective layer limits the number of polymers which may be used for this purpose.

A further disadvantage is that the electrostatic deposition process is a slow process which has the effect of limiting the line speed of the conductor.

Another disadvantage is that while the electrostatic deposition process is performed to overcome the pinhole problem of extrusion, it is found that there is air entrapment in the protective layers of polymer although this is micro-cellular in nature. This is inherent in the electrostatic process and is another reason for the poor elongation properties. In addition, it is believed that there is a boundary weakness at the interfaces of the fused polymer particles which adds to the poor elongation properties. This is because the methods of electrostatic deposition leads to poor intermolecular entanglement at the fused particles interface thus resulting in strain capabilities well below the potential for the same polymers processed at high shear rates.

It would be to advantage in the manufacture of an insulated electrical conductor having a layer of fibrous material as insulation, if the above disadvantages could be minimized or avoided while obtaining the advantages of elongation of an extruded protection.

According to the present invention, there is provided a method for producing an insulated electrical conductor comprising:

providing a conductor having an insulation layer of fibrous material thereon; and forming a surrounding protection for the insulation layer by:

(i) providing a first or inner protective layer for the fibrous material by depositing a polymeric based composition upon the pulp by a process which avoids the use of crushing forces upon the pulp;

(ii) treating the first or inner layer to cause it to harden and, directly in tandem with the hardening treatment;

(iii) applying a second or outer layer of a polymeric composition to the inner layer by extruding it onto the first layer, the hardened inner layer serving to absorb and to protect the fibrous material from crushing forces created by extrusion.

In the above method according to the invention, the inner layer may be formed by electrostatic deposition coating techniques or by bath dipping of the conductor carrying the layer of fibrous material. After such an inner layer has been deposited, it has been found that the outer layer may be extruded upon the inner layer quite successfully and with excellent results. It has in fact been found that the first or inner layer, although of minimal thickness, perhaps down to 2 mils, has had the effect of protecting the extruded or second layer from the influences of the fibrous material which would otherwise create pinholes. Hence, pinholes which would normally be formed in an extrusion over fibrous material, have been avoided. Furthermore, such a thickness of the hardened inner layer provides sufficient resistance against the forces of extrusion to prevent the pulp from being crushed. Hence the disadvantages which would normally be found by extruding a layer of polymeric material over a fibrous material insulation are avoided while gaining the excellent elongation properties of the extruded layer.

It is essential to treat the inner layer to harden it and apply the second layer in tandem with the hardening treatment to obtain desirable adhesion characteristics between the layers. Such adhesion characteristics are not obtainable where the inner layer is allowed to cool before the second layer is added whether or not the surface of the inner layer is reheated prior to the application of the second layer. It is found that when the hardening step and the application of the second layer are not in tandem, the physical characteristics of the surrounding protection are adversely affected, e.g. the elongation properties of the second layer. The actual reasons for this are not known for certain, but it is believed that when the inner layer is allowed to cool, then crystallization at its surface takes place before application of the second layer, thus deleteriously affecting the adhesion characteristics. In addition, whether or not the inner layer is reheated, the temperature gradient through that layer and through the thickness of the whole protection as the second layer is being formed, is different from that achieved when the steps are performed in tandem. This factor may also affect the final results obtainable.

With the method of the invention, because of excellent elongation properties in the outer layer, the additives may be added to the outer layer without detracting unduly from these properties. Hence the thickness of the inner layer is dictated solely by the amount of polymeric material to be electrodeposited to cover the fibrous material before addition of the extruded outer layer and to ensure sufficient strength after hardening to withstand extrusion pressure. As an example, for a 24 AWG conductor, the inner layer of electrodeposited polyamide, need only be from 2 to 3 mils thick. In contrast, with the method described in U.S. Pat. No. 4,131,690, the inner layer needs to be from 3 to 4 mils thick to deposit sufficient additives to suit flame retardant and colouring requirements. Furthermore, the outer layer in this previous method needs to be at least 3 mils thick thus resulting in a total thickness of at least 6 mils provided by electrodeposition. It follows that with the present invention, therefore, the time required for use of the relatively slow electrodeposition process is reduced, thus enabling the line speed to be increased.

In a preferred method, the protection is provided with flame resistant or colouring additives and at least some of these additives are present in the polymeric composition of the outer layer. It is particularly advantageous that the flame retardant and colouring additives are avoided in the inner layer.

The invention also provides an insulated electrical conductor in which the conductor has a layer of pulp insulation covering it and a polymeric protection over the pulp, the protection comprising a first or inner layer of a non-extruded polymeric composition covering the pulp and a second or outer layer of an extruded polymeric composition covering the inner layer.

Figure 2:
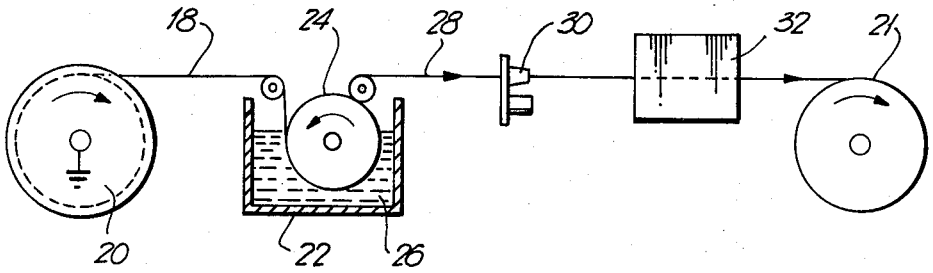
Figure 3:
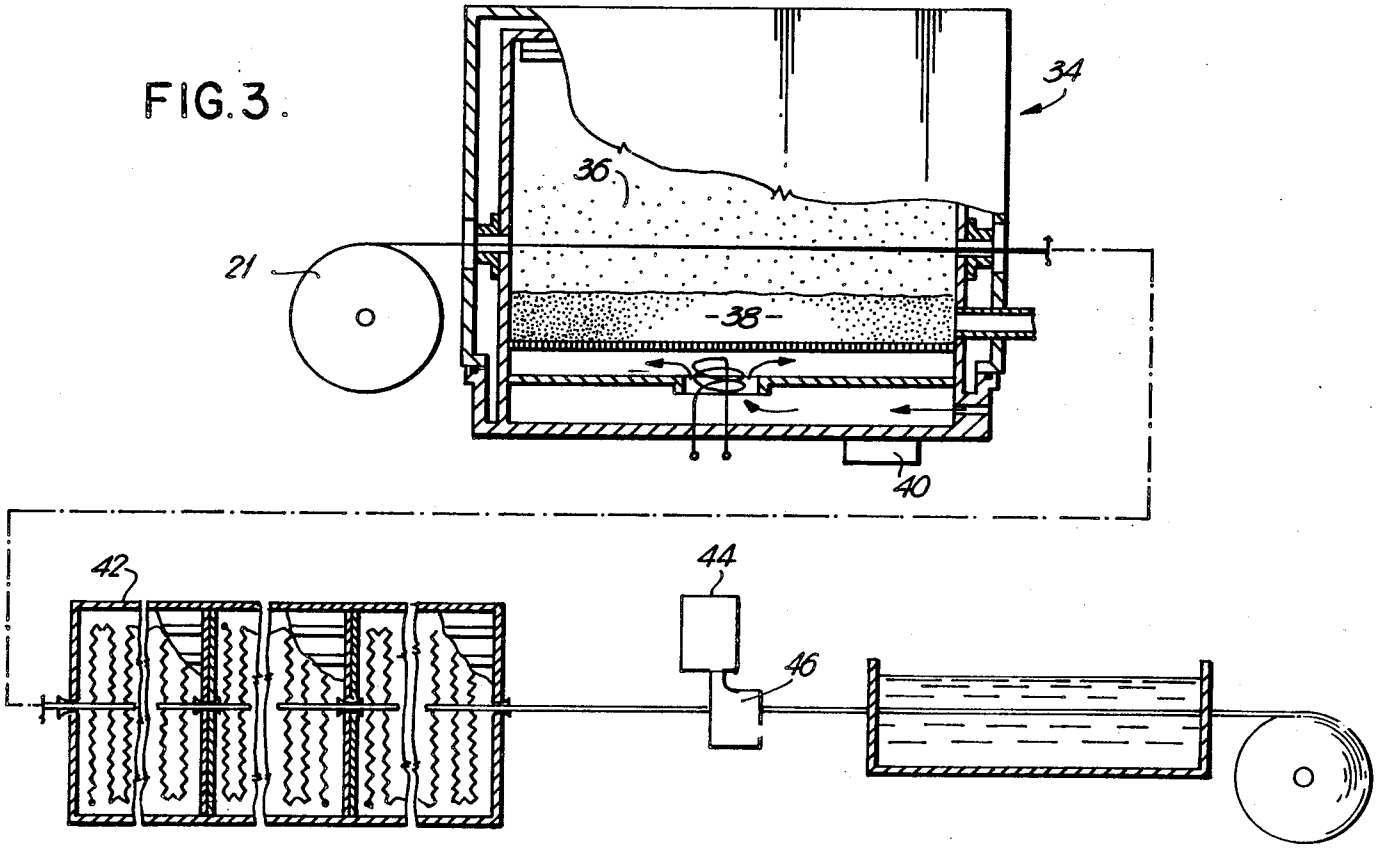

One embodiment of the invention will now be described by way of example with reference to the accompanying drawings in which:

FIG. 1 is a cross-sectional view through an insulated electrical conductor produced by the method of the embodiment; and FIGS. 2 and 3 are schematic side elevational views of apparatus for manufacturing the conductor of FIG. 1.

As shown by FIG. 1, a 24 gauge conductor 10 is covered by a layer of pulp 12, surrounding which is a polymeric protection formed by a first or inner layer 14 and a second or outer layer 16. The inner layer 14 which is from 2 to 3 mils in thickness is formed solely from substantially pure nylon by an electrostatic coating process to be described. The outer layer, which is also from 3-4 mils thick, is formed from a polymeric composition which, in this case, is based on a polyamide containing additives such as flame and fire retardant and colouring materials. The thickness of the inner coat is limited to that merely required to cover the pulp insulation and to smooth down the surface before the outer layer is added and to provide strength after hardening to prevent the extrusion pressure from crushing the pulp.

To manufacture finished insulated conductors as shown in FIG. 1, a plurality of the conductors in the form of copper wires 18 are fed side-by-side from reels 20 (FIG. 2) into a pulp bath 22 and around a cylinder mold 24 partially submerged in the pulp liquid 26. For convenience, FI. 2 shows the process applied to one conductor only. The wires 18 emerge from the bath embedded in a strip coating 28 of pulp insulation and are then passed through a polisher 30 for converting the formed shape of the pulp into annular form surrounding the copper conductor. The pulp covered conductors are then passed through a drying oven 32 in which the pulp is dried and expanded under controlled conditions to give the final pulp diameter and density required to obtain its desired electrical characteristics. The dry pulp is then wound onto reels 21 in preparation for the subsequent stages of the process which are to follow. Up to this stage the process is well-known in the art.

In the subsequent stages (FIG. 3), the reels 21 of conductors carrying the dried pulp travel through an electrostatic chamber 34 where they travel through a cloud of electrically charged particles 36 of the nylon for forming the inner layer 14. The conductors are grounded through their supply reels 21 and attract the nylon particles which electrostatically adhere to the insulation 28. The electrostatic chamber provides a fluidized bed 38 of the particles 36 and these are agitated by a vibrator 40. The construction of the electrostatic chamber 34 is as described for the electrostatic powder coating apparatus in U.S. Pat. No. 4,073,265 issued Feb. 14, 1978 to J. H. Walling and J. A. Jukes.

The pulp insulated conductors covered in powdered nylon particles emerge from the chamber and are then passed through a heating oven 42 for the purpose of treating the nylon powder to cause it to fuse together and form the inner layer and cause it to harden. This oven may be of the construction described in U.S. Pat. No. 4,131,690 for fusing together powder particles after a conductor leaves an electrostatic coating chamber.

At this stage, the inner layer covers the pulp insulation of each conductor to a thickness of between 2 to 3 mil which is sufficient to form a smooth outer surface upon which the outer layer may be extruded.

As shown by FIG. 3, the extrusion apparatus 44 is in tandem with the oven for hardening the inner layer. The extrusion apparatus comprises individual melt pumps 46, one melt pump for each of the insulated conductors. Alternatively, a multi-head melt feeding system may be used. However, the melt pump system is more desirable as it is very efficient in delivering with high accuracy a low output of extruded material required in a multi-strand low-speed operation for individual coating heads. For example, in order to meet the above mentioned product characteristics at a line speed of 200 ft/min. the required output per wire of coating head is approximately 20.5 grams/min.

It is found that when the outer layer 16 is extruded onto the inner layer 14, the hardened inner layer is sufficiently strong to prevent its collapse under the extrusion pressure even though its thickness is of the order of only 2 or 3 mils. Therefore the pulp is not subjected to compression forces by extrusion. Hence, in the finished product, the pulp is of the density and diameter to obtain the desired electrical characteristics for the insulated conductor and the protection layers provide sufficient abrasion resistance and protection against tearing and pulp removal for all mainframe and switchboard wiring conditions.

In addition, the extruded outer layer provides adequate elongation properties to ensure that broken ends of conductor are covered by a polymeric protection when the wire is broken due to excessive tensile forces. A quality requirement for the elongation properties for a polymer protection layer over pulp insulation is that the polymeric material must have an elongation rate of at least 90% of its original length before breakage occurs, to ensure that adequate protection is provided for the broken end of conductor.

In an experiment, an insulated conductor was provided with two layers of polymeric protection material, both of the layers being formed of a polyamide composition with the inner layer containing the colouring material necessary to identify the wire and also the fire and flame retardant additives. The outer layer was thus substantially pure polyamide with virtually no additives included. These layers were added to the pulp by electrostatic deposition techniques. Under test conditions, and with the conductors removed, a large population of samples of the protection formed in this manner were subjected to tensile forces up to their breakage. It was found that up to 30% of the samples of protection had failed before extending at least 90% of their original length.

The above results were compared with tests performed upon samples of protection made according to the present invention. In these samples made according to the invention and as exemplified by the present embodiment, the outer layer of material in ten samples was of natural polyamide extruded material with no additives; in ten other samples, according to the invention, a black colouring die was added. These twenty samples were tested by applying a tensile load to obtain the elongation of the samples to break. The average elongation to break of all test samples of the polymeric protection was 225% of the original length.

In further tests, samples were made as described in the embodiment, except that the extrusion apparatus 44 was not in tandem with the oven 42 for hardening the inner layer. In this case, the inner layer was allowed to cool before the outer or second layer was extruded onto it. In tensile loading tests on these latter samples, it was discovered that, in every sample, the protection failed before reaching an extension of 90% of its original length.

The above experiment is a clear indication that the protection having the extruded outer layer according to the invention have elongation properties far exceeding those required and also far exceeding those which are available using electrostatic coating techniques.

Thus the above discussion shows clearly that a desirable extruded polymeric protection having its advantageous elongation properties is a feasible proposition if the underlayer is applied by techniques which do not call for compression of the pulp insulation and has sufficient strength after being hardened to withstand the extrusion pressures of the outer layer.

Various polymeric materials are available which will provide the elongation properties required for the purposes of the invention. Suitable polyamide materials are available from Hüls and are referred to as PAE grades of polyamide elastomers within their VESTAMID range. Of these grades, grades X3982 and X4017 are worthy of mention as these include flame retardants as sold by that Company. Grade X4017 has a percentage elongation before break, of 300%. Another suitable polyamide is sold by Ato Chimie SA under the name RILSAN (Registered Trade Mark) which has an elongation at break of about 280%.

What is claimed is:

1. A method of producing an insulated electrical conductor comprising:

providing a layer of dried pulp insulation upon a conductor by applying wet pulp and drying it to expand it before adding any further layers of any material; and forming a surrounding protection for the insulation layer by:

(i) providing a first or inner protective layer for the dried pulp by depositing a polymeric based composition upon the pulp by a process which avoids the use of crushing forces upon the pulp;

(ii) heating the first or inner layer to cause it to harden and, then directly in tandem with the hardening treatment and with the inner layer retained in a heated state;

(iii) applying a second or outer layer of a polymeric composition to the inner layer by extruding it onto the first layer, the hardened inner layer serving to absorb and protect the, pulp from crushing forces created by extrusion.

2. A method according to claim 1, wherein the protection is provided with flame resistant or colouring additives, and the outer layer has some at least of these additives in its polymeric composition.

3. A method according to claim 1, wherein the inner layer is devoid of fire or flame retardant and colouring additives, and the outer layer includes fire and flame retardant and colouring additives.

* * * * *